US009650867B2

(12) United States Patent
Pabon et al.

(10) Patent No.: US 9,650,867 B2
(45) Date of Patent: May 16, 2017

(54) APPARATUS AND METHODS FOR ACTIVATING A PLURALITY OF DOWNHOLE DEVICES

(71) Applicant: SCHLUMBERGER TECHNOLOGY CORPORATION, Sugar Land, TX (US)

(72) Inventors: Jahir Pabon, Newton, MA (US); Kuo-Chiang Chen, Sugar Land, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 567 days.

(21) Appl. No.: 13/856,268

(22) Filed: Apr. 3, 2013

(65) Prior Publication Data

US 2014/0299319 A1 Oct. 9, 2014

(51) Int. Cl.

| | |
|---|---|
| ***E21B 34/14*** | (2006.01) |
| ***E21B 41/00*** | (2006.01) |
| ***E21B 43/26*** | (2006.01) |

(52) U.S. Cl.

CPC ..... *E21B 34/14* (2013.01); *E21B 41/00* (2013.01); *E21B 43/26* (2013.01)

(58) Field of Classification Search

None

See application file for complete search history.

(56) References Cited

U.S. PATENT DOCUMENTS

| | | | | |
|---|---|---|---|---|
| 7,866,396 | B2 | 1/2011 | Rytlewski | |
| 8,211,247 | B2 | 7/2012 | Marya et al. | |
| 2014/0246209 | A1* | 9/2014 | Themig | E21B 33/12 166/374 |
| 2015/0247380 | A1* | 9/2015 | Avery | E21B 34/14 166/373 |

OTHER PUBLICATIONS

Schlumberger, "TAP Completion System: Multizone completions in a single, continuous operation", Dec. 2007, 4 pages.

* cited by examiner

*Primary Examiner* — Caroline Butcher

(74) *Attorney, Agent, or Firm* — Bridget M. Laffey

(57) ABSTRACT

A mechanism for selectively activating a plurality of downhole pathways. The method includes a casing segment which includes a plurality of casing ribs, a valve which includes a sleeve coupled for movement between an open and normally closed position, a rocker member mounted to the sleeve, a dart for pumping in hole including a dart profile matched to the rocker member profile such that the dart profile couples to the rocker member profile when in close proximity and, in turn, the sleeve moves using hydraulic force from the closed position to the open position.

15 Claims, 6 Drawing Sheets

301
313
315
317
319
321
323

APPARATUS AND METHODS FOR ACTIVATING A PLURALITY OF DOWNHOLE DEVICES

FIELD

This subject disclosure relates generally to recovery of hydrocarbons in subterranean formations, and more particularly to a mechanism for activating a plurality of downhole devices such as when creation of multiple production zones is desired.

BACKGROUND

There are many situations when one would like to selectively activate multiple downhole devices. For example, in typical wellbore operations, various treatment fluids may be pumped into the well and eventually into the formation to restore or enhance the productivity of the well. For example, a non-reactive fracturing fluid may be pumped into the wellbore to initiate and propagate fractures in the formation thus providing flow channels to facilitate movement of the hydrocarbons to the wellbore so that the hydrocarbons may be pumped from the well.

In such fracturing operations, the fracturing fluid is hydraulically injected into a wellbore penetrating the subterranean formation and is forced against the formation strata by pressure. The formation strata is forced to crack and fracture, and a proppant is placed in the fracture by movement of a viscous-fluid containing proppant into the crack in the rock. The resulting fracture, with proppant in place, provides improved flow of the recoverable fluid (i.e. oil, gas or water) into the wellbore. Often it is desirable to have multiple production zones which are treated differently within the wellbore. To isolate and treat each zone separately, previous mechanisms have been time consuming and expensive among other drawbacks.

Due to the heterogenous nature of formation, one might not want to open all the valves simultaneously so that the fracturing operations can be performed separately for different layers of formation. The most common way of doing so is using graduated balls or darts to open the valves from the bottom up. For example, the radius of the valves, or other restrictions such as a protrusion on the sliding sleeve, will increase from the bottom up. Then, the smallest size ball is first dropped into the well and pumped toward the bottom. The size of the ball is designed so that the ball will pass through the valves except the bottom, narrowest valve. The ball is stopped by the valve so that the sliding sleeve of the bottom valve is pushed to the "open" position to expose the wellbore to cemented formation. Then the fracturing operation through the bottom valve can be executed. After that, the next size larger ball will be dropped to activate the second to bottom valve.

The drawbacks of the graduated ball activation system are that there are only a finite number of restrictions/ball sizes that can be implemented. Typical limitations are a 4.5 inch casing at the top with a minimum of 1 inch at the bottom. Hence, five or six valves across a few hundred feet of depth is the physical limit. Further, the need for restrictions prevents the full-bore access through the valves and the valves have to be activated in a fixed sequence of, in this case, bottom-up. After activation, the balls have to be dissolved or milled to gain access to the sections therebelow, which can lead to a potentially costly intervention.

Another embodiment of valve activation at varying depth utilizes control lines to activate restrictions. Once a restriction in a particular valve is activated, the restriction is then ready to catch a ball or dart dropped from the surface in order to open the respective valve. In these embodiments, common concerns are the possible damage of control lines during run-in-hole, especially in horizontal wells. A damaged control line means that those lines below the damaged zone can be produced, severely impacting the total potential production from the well, possibly rendering it uneconomical. Another drawback of such designs is that as the thickness of the valve increases, the internal diameter of the valve decreases in order to accommodate the complex hydraulic mechanisms in the valve.

The subject disclosure overcomes many of the problems associated with activating a plurality of downhole devices.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

According to some embodiments, a mechanism for selectively activating a plurality of downhole pathways is disclosed. In embodiments, the mechanism comprises a casing segment including a plurality of casing ribs; a valve including a sleeve coupled for movement between an open and normally closed position; a plurality of rocker members mounted pivotably to the sleeve, the plurality of rocker members configured to move back and forth as a dart is pumped in hole and passes by the sleeve. The dart comprises a dart profile which is matched to a rocker member profile, the dart profile coupling to the rocker member profile when in close proximity and, in turn, the sleeve moves downward by the distance between the casing ribs.

In further embodiments, a mechanism for selectively opening a plurality of valves is described. The mechanism comprises a casing segment including a plurality of casing ribs, a valve including a sleeve coupled for movement between an open and normally closed position and a plurality of rocker members mounted pivotably to the sleeve. The plurality of rocker members are configured to move back and forth as a dart is pumped in hole and passes by the sleeve, the plurality of rocker members and dart moving the sleeve downward by the distance between the casing ribs and the valve opening after the sleeve has moved a predetermined number of steps.

In embodiments, a method for selectively activating a triggering mechanism on a plurality of downhole valves is disclosed. The method comprises predetermining a number of casing ribs on a casing segment such that each valve sleeve of the downhole valves includes a predetermined number of casing ribs; and opening the downhole valves in sequence by selecting a sequence of darts to be pumped in hole.

Further features and advantages of the subject disclosure will become more readily apparent from the following detailed description when taken in conjunction with the accompanying drawings.

BRIEF DESCRIPTION OF THE DRAWINGS

The subject disclosure is further described in the detailed description which follows, in reference to the noted plurality of drawings by way of non-limiting examples of embodiments of the subject disclosure, in which like reference numerals represent similar parts throughout the several views of the drawings, and wherein:

FIGS. 3-1 to 3-6 is a cross-sectional view of a valve in a layout in accordance with the subject technology; wherein an activation dart is approaching the valve;

FIG. 4 is a cross-sectional view of a valve in a layout in accordance with the subject technology; wherein an activation dart has opened the valve;

FIG. 5 is a cross-sectional view of a valve in a layout in accordance with the subject technology; and FIG. 6 is a cross-sectional view of a valve in a layout in accordance with the subject technology.

DETAILED DESCRIPTION

The particulars shown herein are by way of example and for purposes of illustrative discussion of the embodiments of the subject disclosure only and are presented in the cause of providing what is believed to be the most useful and readily understood description of the principles and conceptual aspects of the subject disclosure. In this regard, no attempt is made to show structural details in more detail than is necessary for the fundamental understanding of the subject disclosure, the description taken with the drawings making apparent to those skilled in the art how the several forms of the subject disclosure may be embodied in practice. Furthermore, like reference numbers and designations in the various drawings indicate like elements.

In overview, several embodiments of the subject technology are directed to using a stepping mechanism to accomplish the beneficial goals noted above among other benefits. The stepping mechanism described here may be used to define a sequential order for the activation of multiple valves for downhole applications.

Embodiments disclose a mechanism that limits the movement of a sleeve as the "ball" passes through it, to a well defined increment or "step." Valves may be built so that the corresponding sleeve moves a specific number of "steps" before it may be opened. A sequential order may be achieved by building the sleeves so that the bottom-most sleeve opens in a single step which is after one single ball drop; the next sleeve above opens in two steps, after two balls are dropped; and so forth, the top sleeve requiring the greatest number of steps to open.

Figure 1:
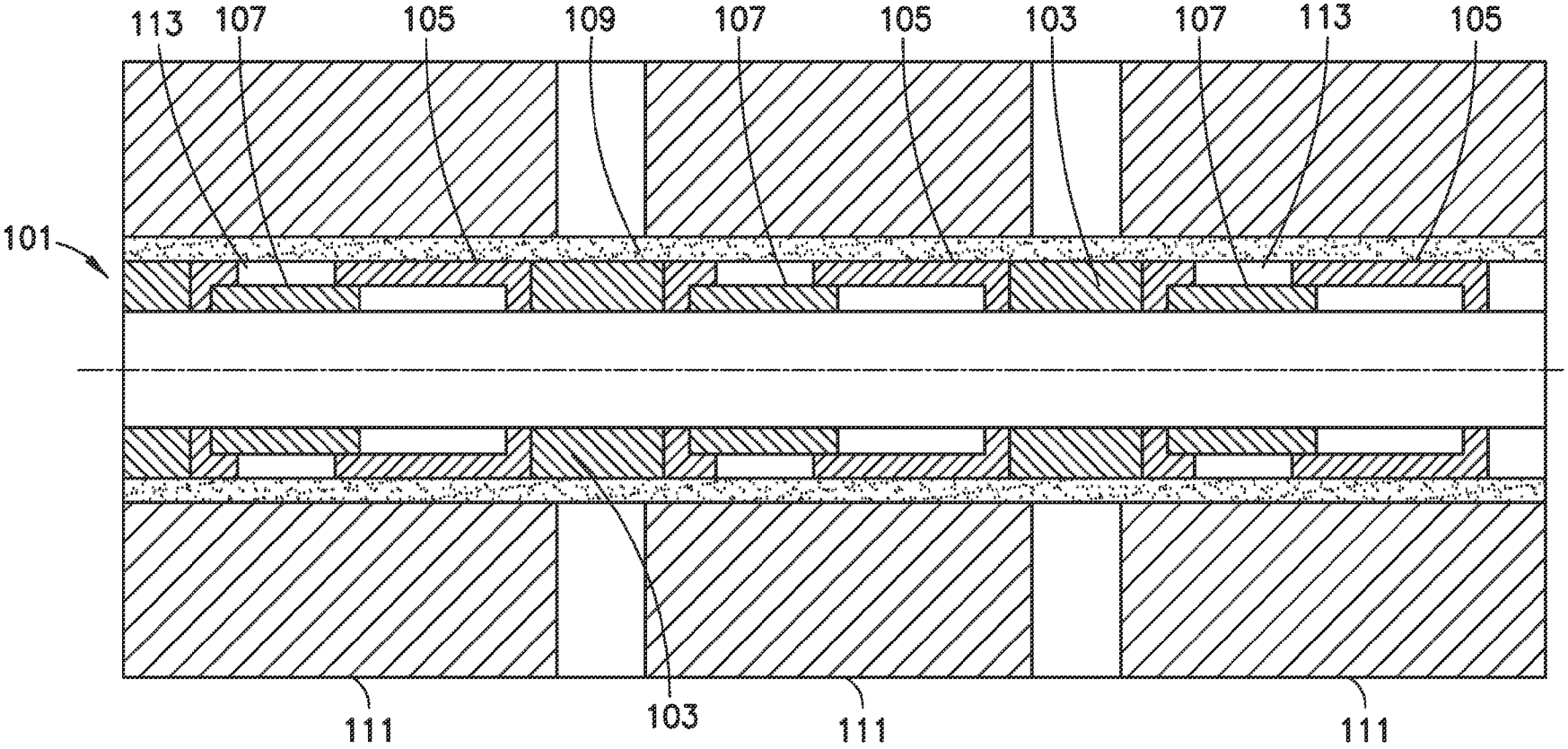
FIG.1 PRIOR ART
FIG. 1 is a cross-sectional view of a layout for a typical wellbore.

Referring now to FIG. 1, a layout 101 of valves 105, sleeves 107 and zones 111 to be stimulated is shown. The sleeves 107 are slideably mounted within the valves 105 to selectively open pathways 113. As illustrated, there is one valve 105 per zone 111. Each valve 105 is fixed in place by cement 109 and separated by casing 103. Although just three zones 111 are shown, there may be any desired number of casing valves 105 with sliding sleeves 107 cemented in a well.

Figure 2:
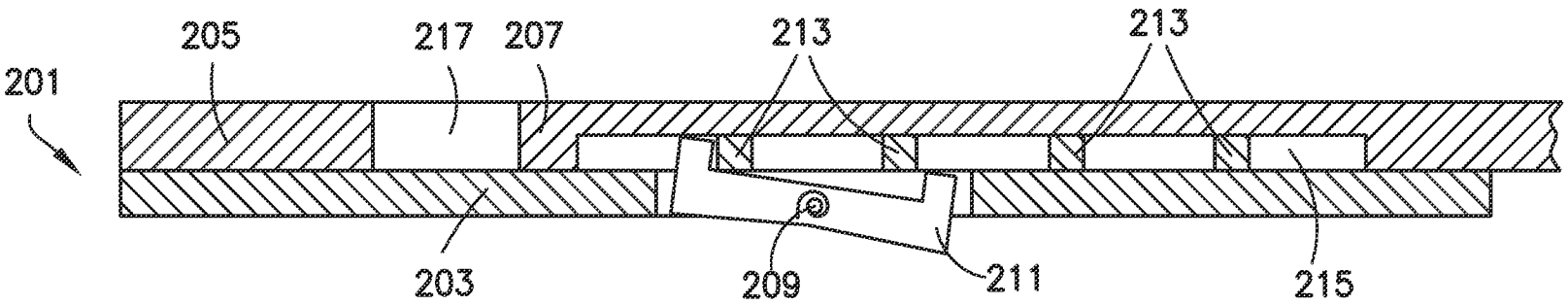
FIG. 2 is a cross-sectional view of a valve in a layout in accordance with the subject technology.

Referring now to FIG. 2, a cross-sectional view of a layout 201 having a valve 207 in the closed position in accordance with the subject technology is shown. In order to accomplish multiple zones, multiple such casing valves 207 would be run in hole with casings 205 and held in place by cement. Each casing valve 207 has a sliding sleeve 203, shown in the "closed" position, i.e., there is no communication between the wellbore to the surrounding formation. In other words, the sliding sleeve 203 blocks the pathway 217 formed in the casing valve 207. Casing 205 surrounds the casing valve 207.

The sliding sleeve 203 interacts with an activation dart to open the valve 207. Each zone intended for production has a recess 215 with a predetermined plurality of casing ribs (or lips) 213. The sliding sleeve 203 has one or more rocking elements 211 which are distributed around the circumference. The activation dart has a particular shape that interacts with the one or more rocking elements 211. The shape profile of the activation dart matches the shape profile of a rocking element 211 so that the activation dart profile when it reaches the rocking element profile 211 is able to engage with the rocking element profile 211 so that the activation dart profile is stopped by and/or begins moving with the sliding sleeve 203. These elements 211 can pivot 209 similar to a "rocker" and the rocker ends protrude radially outward so that they are axially constrained within the casing ribs 213. The sleeve 203 is segmented to accommodate the rocker 211.

Figures 1, 2, 3, 4, 5, 6:
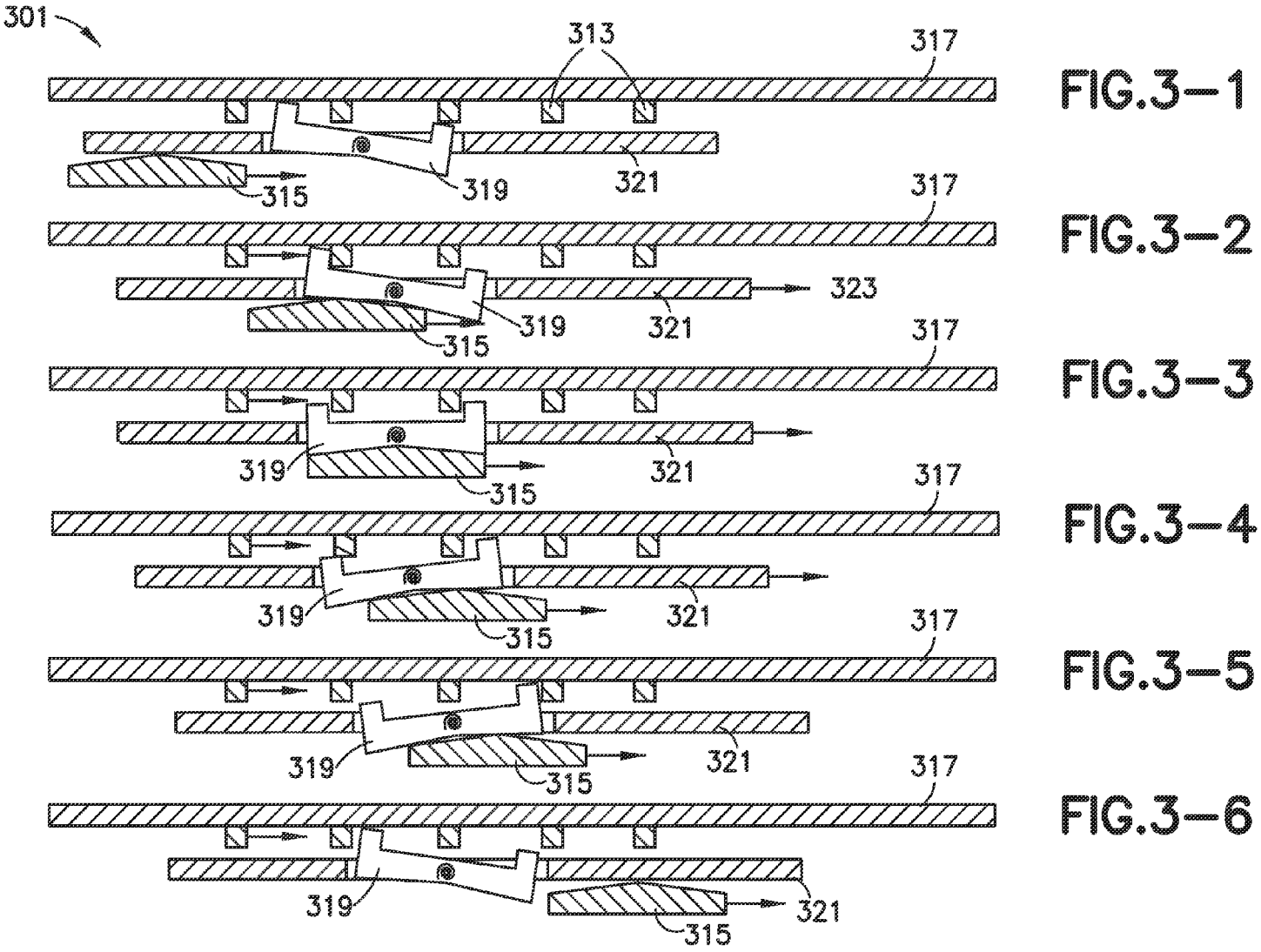
Figure 4:
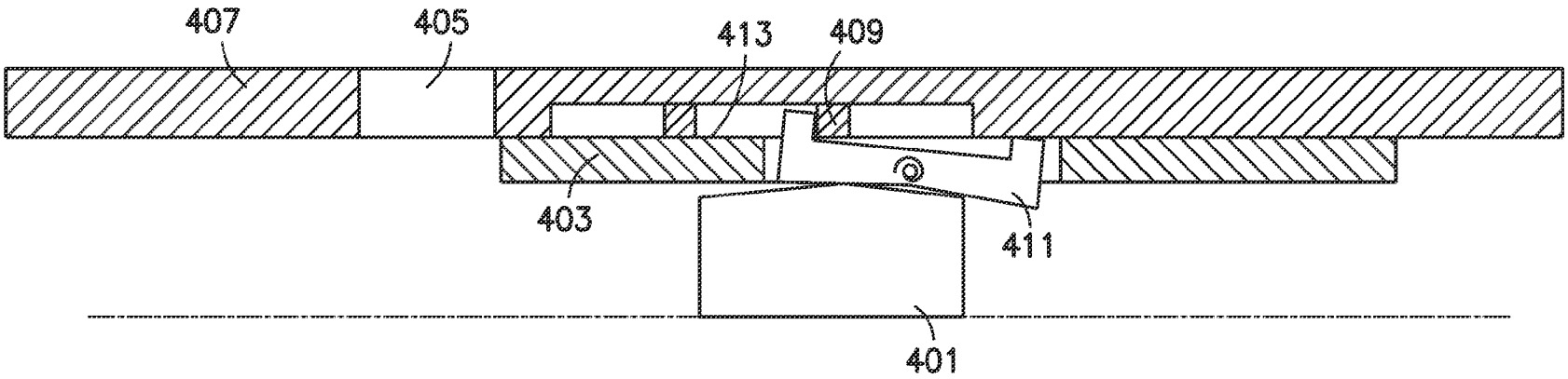
Figure 5:
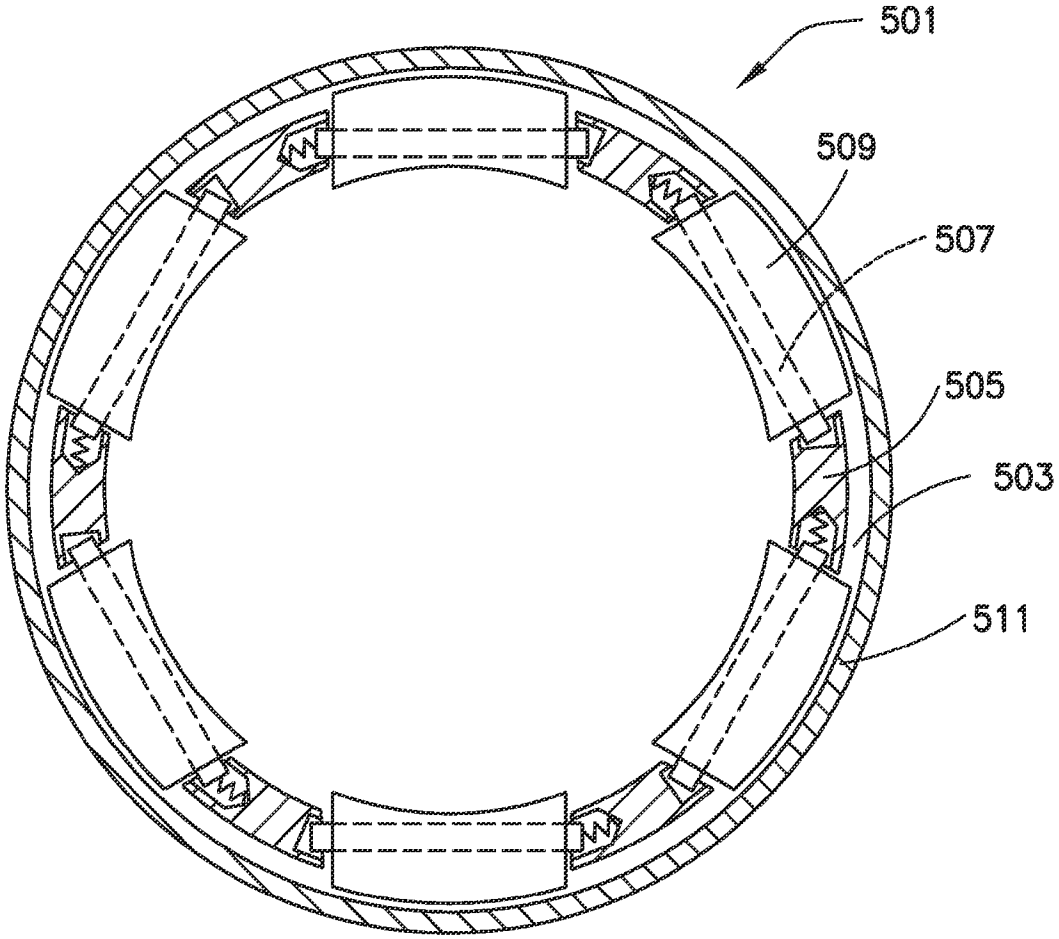
Figure 6:
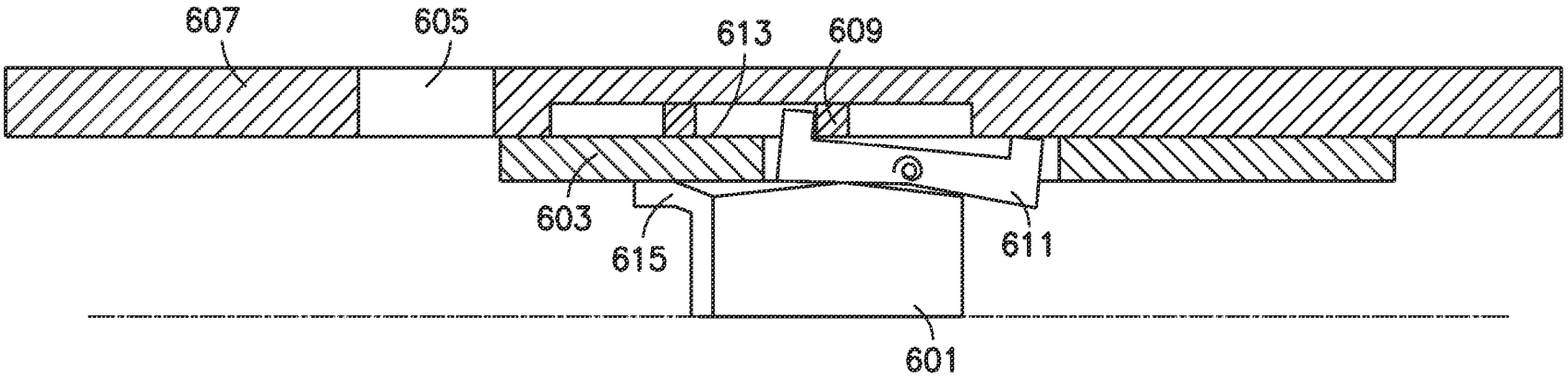

Referring now to FIG. 3, a cross-sectional view of a portion of a valve 301 in accordance with the subject technology is shown, wherein an activation dart 315 has reached the valve 301. As the activation dart 315 passes by the sleeve the profiles of the activation dart 315 and the rocker 319 are designed such that the rocker 319 is forced to turn back and forth. At the same time the sleeve axial position 321 incrementally moves downward 323 by the distance between the casing ribs. This movement of the dart 315 is depicted in FIGS. 3-1 to FIG. 3-6. As can be seen in FIG. 3 the dart profile 315 and the rocker profile 319 are designed such that when the dart profile 315 reaches the rocker profile 319 they engage each other so that the dart 315 is stopped by and/or begins moving with the sliding sleeve 321. The sliding sleeve 321 incrementally moves downward 323 as the dart 315 moves.

As the activation dart is pumped down and passes by the sliding sleeve 323, the profiles of the dart and the rocker are designed such that the rocker is forced to turn back and forth while at the same time the sliding sleeve 323 axial's position incrementally moves downward by the distance between casing ribs 313. In non-limiting examples, the distance between casing ribs is about 0.5 to 1 inch. The activation dart forms a hydraulic barrier between the space above and below the activation dart in the wellbore, which allows dropping the activation dart from the surface of the well and pumping the dart down the well. In non-limiting examples, the density of the activation dart is heavier than the well fluid to facilitate dropping the activation dart into the wellbore from the surface of the wellbore.

The activation darts continue to pass the valve 301, the number of activation darts which will pass the valve 301 is determined by the number of "ribs" 313 that the sliding sleeve 321 has to pass. In one non-limiting example, as can be seen in FIG. 3, the sliding sleeve has to pass four "ribs" 313. Once the sliding sleeve 321 reaches the end of its stroke, the valve 301 is in the open position, and the "rocker" elements 315 are constrained between the casing 317 and the activation dart, so that the activation dart is prevented from moving any further and effectively blocks fluid communication.

The casing recess on each production zone has a different number of "ribs" 313 in the recess. The number of "ribs" 313 preferentially increases monotonically from bottom to top. The bottom most zone preferentially has a single rib, the next one above has two ribs, and so forth. This way the bottom zone will be opened when the first "dart" is sent down the well. The next zone will be opened with the second dart, and so forth, until the top zone is opened.

Referring now to FIG. 4, the sleeve 403 has reached the end of its stroke. The sleeve 403 reaches the end of its stroke after enough "darts" have passed through, the specific number of darts is determined by the number of "ribs" the sleeve 403 has to pass by. As can be seen the valve 405 is in the open position and the rocker element 411 is constrained between the casing 407 and the ball/dart 401 so that the ball/dart 401 is prevented from moving any further and effectively blocks the fluid communication. As the pumping continues, the hydraulic forces exerted on the dart 401 keep the sliding sleeve 405 in the "open" position. As a result, the pathway is open, and the valve 405 is ready for a wellbore operation, in a non-limiting example, a fracturing operation.

It is noted that full-bore access is achieved because a recess 413 in the sliding sleeve 403 is used for activation instead of a restriction or protrusion. The valve will not be activated until enough darts have passed through. When the valve is not activated, the formation behind this particular valve will not be affected by subsequent fracturing operations. The dart 401 may be made of a degradable material or drilled out for removal. In non-limiting examples, the degradable material may be a composite material containing fibers that degrade overtime in the wellbore. In other examples, the degradable material may comprise materials as disclosed in a related co-owned U.S. Pat. No. 8,211,247, entitled "Degradable compositions, apparatus comprising same, and method of use," the contents of which are herein incorporated by reference.

FIG. 5 depicts a cross-sectional view of a portion of a valve 501 in accordance with the subject technology. In order to accomplish multiple zones, multiple such casing valves 501 could be run in hole with casing 511 and held in place by cement. Each casing valve 501 has a sliding sleeve 505 and a predetermined plurality of casing ribs (or lips) 503. The sliding sleeve 505 has one or more rocker elements 509 which are distributed around the circumference. These rocker elements 509 can pivot on a spring loaded pivot 507 similar to a "rocker" and the rocker ends protrude radially outward so that they are axially constrained within the casing ribs 503.

Referring now to FIG. 6, a cross-sectional view of a layout having a valve 613 in the open position in accordance with the subject technology is shown. The sleeve 603 has reached the end of its stroke. The sleeve 603 reaches the end of its stroke after enough "darts" have passed through, the specific number of darts is determined by the number of "ribs" 609 the sleeve 603 has to pass by. As can be seen the valve 613 is in the open position and the rocker element 611 is constrained between the casing segment 607 and the ball/dart 601 so that the ball/dart 601 is prevented from moving any further and effectively blocks fluid communication. Blocking of fluid communication is enhanced by a sealing element 615 on the ball/dart 601. As the pumping continues, the hydraulic forces exerted on the dart 601 keep the sliding sleeve 613 in the "open" position. As a result, the pathway is open 605, and the valve 613 is ready for a fracturing operation.

Although the subject disclosure has been described with respect to valves it should be recognizable to those skilled in the art that the triggering mechanisms disclosed may be used for other downhole applications, where there is a need to selectively activate a series of device actuations, in a non-limiting example, a packer device.

Although only a few example embodiments have been described in detail above, those skilled in the art will readily appreciate that many modifications are possible in the example embodiments without materially departing from the subject disclosure. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

What is claimed is:

1. A mechanism for selectively activating a plurality of downhole pathways comprising:

a casing segment including a plurality of casing ribs;

a valve including a sleeve coupled for movement between an open and closed position;

a plurality of rocker members mounted pivotably to the sleeve, the plurality of rocker members configured to move back and forth as a dart is pumped downhole and passes by the sleeve; and wherein the dart comprises a dart profile which is matched to a rocker member profile, the dart profile coupling to the rocker member profile when in close proximity and forcing the rocker member to move back and forth and simultaneously, the sleeve moves by a distance between the casing ribs.

2. The mechanism of claim 1, wherein the valve opens after movement of the sleeve past a defined number of casing ribs.

3. The mechanism of claim 2, wherein the number of casing ribs per wellbore zone increases incrementally from a bottom zone of a wellbore to a top zone of the wellbore.

4. The mechanism of claim 3, wherein the bottom zone of the wellbore has one casing rib.

5. The mechanism of claim 1, wherein the plurality of casing ribs are placed in sequence with the highest number of casing ribs near a surface of a wellbore.

6. The mechanism of claim 1, wherein the plurality of casing ribs is positioned in a recess of the casing segment.

7. The mechanism of claim 6, wherein each zone in a wellbore has a different number of casing ribs positioned in the recess of the casing segment.

8. The mechanism of claim 1, wherein the rocker member is elongate and both ends protrude radially outward so that the ends are axially constrained within the plurality of casing ribs.

9. The mechanism of claim 1, wherein the valve is open after the sleeve reaches the last casing rib and the plurality of rocker members are constrained between the casing segment and the dart wherein the dart is prevented from moving and blocks fluid communication in a wellbore.

10. The mechanism of claim 1, wherein the sleeve is segmented to accommodate the plurality of rocker members.

11. The mechanism of claim 1, wherein the dart comprises a sealing element.

12. A mechanism for selectively opening a plurality of valves comprising:

a casing segment including a plurality of casing ribs;

a valve including a sleeve coupled for movement between an open and closed position;

a plurality of rocker members mounted pivotably to the sleeve, the plurality of rocker members configured to move back and forth as a dart is pumped into a wellbore and passes by the sleeve, and as a rocker member of the plurality of rocker members moves back and forth the sleeve moves simultaneously by a distance between the casing ribs; and wherein the valve opens after the sleeve has moved a predetermined number of casing ribs.

13. The mechanism of claim 12, further comprising degrading the dart.

14. The mechanism of claim 12, wherein the dart comprises a sealing element.

15. The mechanism of claim 12, including positioning the plurality of casing ribs in a recess of the casing segment.

* * * * *